US008690703B2

(12) United States Patent
Chen

(10) Patent No.: US 8,690,703 B2
(45) Date of Patent: Apr. 8, 2014

(54) GOLF CLUB

(75) Inventor: Yiwen Chen, Taipei (TW)

(73) Assignee: Fusheng Precision Co., Ltd, Taipei (TW)

( * ) Notice: Subject to any disclaimer, the term of this patent is extended or adjusted under 35 U.S.C. 154(b) by 292 days.

(21) Appl. No.: 13/212,269

(22) Filed: Aug. 18, 2011

(65) Prior Publication Data

US 2012/0046123 A1 Feb. 23, 2012

(30) Foreign Application Priority Data

Aug. 19, 2010 (CN) ..... 2010 2 0297270 U

(51) Int. Cl.
*A63B 53/04* (2006.01)
*A63B 53/14* (2006.01)

(52) U.S. Cl.
USPC ..... 473/324; 473/316; 427/262; 101/487

(58) Field of Classification Search
USPC ..... 473/324, 316; 472/262; 101/487; 427/262
See application file for complete search history.

(56) References Cited

U.S. PATENT DOCUMENTS

| | | | | |
|---|---|---|---|---|
| 5,337,670 | A * | 8/1994 | Huang | 101/487 |
| 5,340,610 | A * | 8/1994 | Thompson | 427/267 |
| 5,686,155 | A * | 11/1997 | Suzue et al. | 428/34.5 |
| 7,090,591 | B2 * | 8/2006 | Sano | 473/324 |
| 2005/0272522 | A1 * | 12/2005 | Chen et al. | 473/324 |
| 2008/0076593 | A1 * | 3/2008 | Costa et al. | 473/316 |
| 2008/0307631 | A1 * | 12/2008 | Lin et al. | 29/527.4 |
| 2009/0137336 | A1 | 5/2009 | Hsu et al. | |
| 2009/0233731 | A1 | 9/2009 | Hsu et al. | |

* cited by examiner

*Primary Examiner* — Benjamin Layno
(74) *Attorney, Agent, or Firm* — Alan Kamrath; Kamrath IP Lawfirm, P.A.

(57) ABSTRACT

A golf club has a head including a base layer and a compounded transfer layer. The base layer has a coupling face. The compounded transfer layer is formed on the coupling face of the base layer. The compounded transfer layer has a dye layer and a protection layer. The dye layer is sandwiched between the base layer and the protection layer.

12 Claims, 4 Drawing Sheets

GOLF CLUB

BACKGROUND OF THE INVENTION

1. Field of the Invention

The present invention generally relates to a golf club and, more particularly, to a golf club with a compounded transfer layer formed on a head thereof.

2. Description of the Related Art

A golf club usually consists of a grip, a shaft and a head. A golf player can swing the golf club by grasping the grip. The shaft is connected between the grip and the head. The head usually has some plane patterns or texts on it. To form a pattern on the head of the golf club, it is required to prepare a paint that has a bottom color of the pattern. The paint should be sprayed on a surface of the head first. Then, a film or gummed tape is provided to make the pattern, and the pattern is adhered to the surface of the head. Next, another paint with a different bottom color is prepared and sprayed on the surface of the head again. Finally, the file or gummed tape is removed from the golf club, thereby forming the pattern on the head of the golf club.

In the above mechanism, multiple layers of patterns can be transferred onto the head of the golf club by paint spraying. However, only a single color of paint can be sprayed on the head each time painting the golf club. In this regard, the same portion of the golf club will be painted many times and therefore requires multiple baking operations. Thus, in a case where there are many colors to be painted on the golf club, not only does it take a long time to transfer multiple layers of patterns on the golf club, but it also results in a waste of paints.

In light of this problem, another golf club was proposed. During manufacture of the golf club, a grinding and polishing process is applied to a predetermined area of the golf club where a pattern is to be transferred. Then, a pattern layer is directly transferred onto the predetermined area of the golf club by way of water transfer printing or heat transfer printing. The pattern layer has at least a bottom color and is an opaque ink layer in order to form a pattern on the golf club. Finally, the pattern on the golf club is coated with a polyurethane (PU) flat varnish for protection.

In the above mechanism, the pattern layer is transferred onto the golf club and a protection coating is formed on the pattern layer for protection. Therefore, a multiple-layered structure is formed on the golf club. Since the pattern layer is opaque and the protection coating (PU flat varnish) is transparent, the pattern on the golf club can be clearly seen through the protection coating. However, it takes two additional processes (pattern transferring and paint spraying) to form the pattern layer and the protection layer, so it will be more difficult to manufacture the golf club. As a result, overall productivity is limited. In light of this, there is a need to improve the conventional golf club.

SUMMARY OF THE INVENTION

It is therefore the primary objective of this invention to provide a golf club with a compounded transfer layer, which comprises both a pattern and a protection layer, formed on a head thereof in only a single process. As such, the production rate of the golf club can be increased.

It is another objective of this invention to provide a golf club with a compounded transfer layer formed on a head thereof for display of a predetermined pattern.

The invention discloses a golf club having a head. The head comprises a base layer and a compounded transfer layer. The base layer has a coupling face. The compounded transfer layer is formed on the coupling face of the base layer. The compounded transfer layer has a dye layer and a protection layer. The dye layer is sandwiched between the base layer and the protection layer.

Furthermore, the invention discloses a golf club having a shaft. The shaft comprises a base layer and a compounded transfer layer. The base layer has a coupling face. The compounded transfer layer is formed on the coupling face of the base layer. The compounded transfer layer has a dye layer and a protection layer. The dye layer is sandwiched between the base layer and the protection layer.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
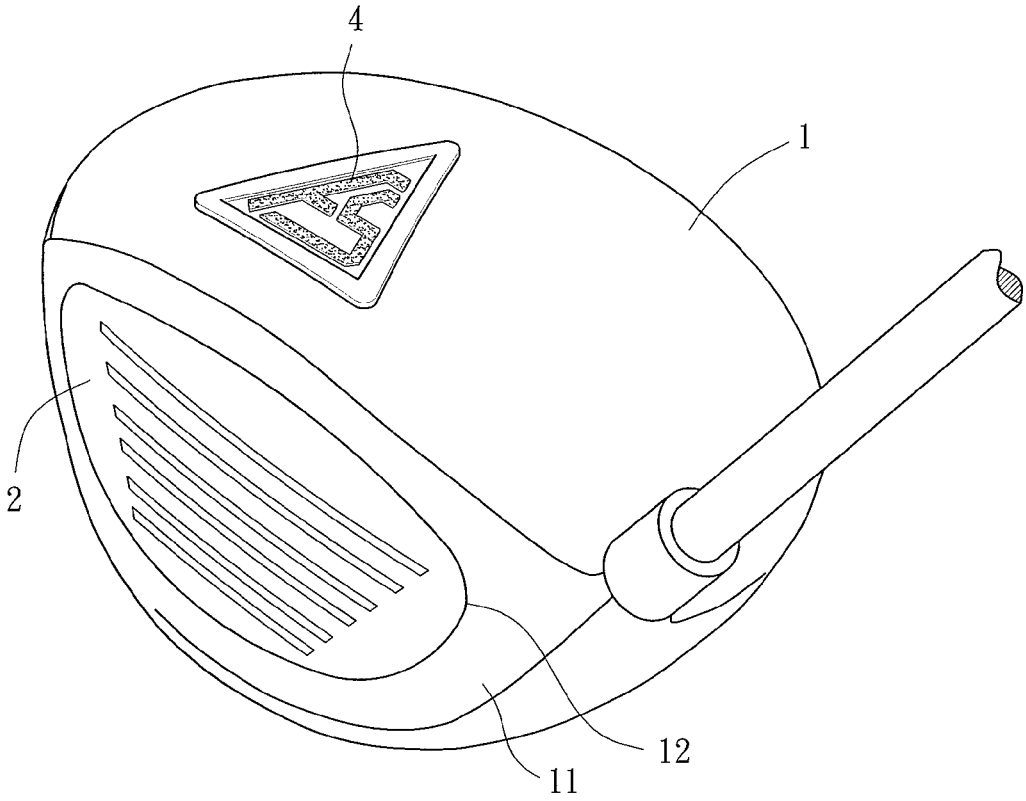
FIG. 1 shows a golf club having a compounded transfer layer formed on a top face of a head thereof according to a first embodiment of the invention.

In the various figures of the drawings, the same numerals designate the same or similar parts. Furthermore, when the terms "first", "second", "third", "fourth", "inner", "outer", "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Referring to FIG. 1, a golf club is disclosed according to a first embodiment of the invention. The golf club may be a wooden club, an iron club or a putter club. The golf club may be made of materials such as a carbon steel, a stainless steel (such as 17-4PH stainless steel), an alloy steel, a ferrum-manganes-aluminum (Fe—Mn—Al) alloy, a nickel base alloy, a cast iron, a super alloy steel, a titanium alloy, a copper alloy, an aluminum alloy, a magnesium alloy, a carbon fiber or combinations thereof.

In this embodiment, the wooden club is chosen as the golf club. The golf club includes a head 1 and a ball-striking panel 2. The head 1 includes a ball-striking face 11 having an assembling portion 12. The ball-striking panel 2 is received in the assembling portion 12.

Figure 2:
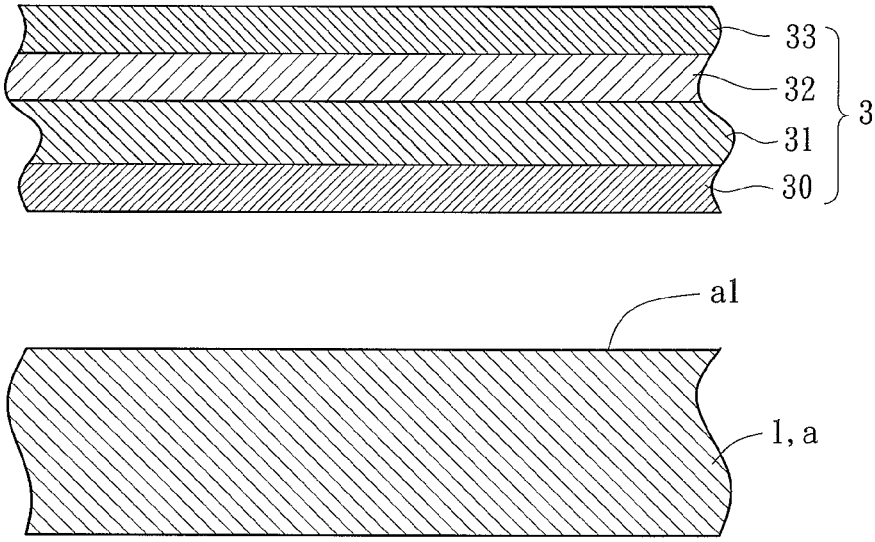
FIG. 2 is a cross-sectional view of the golf club of the first embodiment before the compounded transfer layer is formed on the head of the golf club.

Referring to FIGS. 1 and 2, the head 1 serves as a base layer 1, a having a coupling face a1 being an outer face of the head 1. The golf club of the invention may further comprise a compounded transfer layer 3 that can be directly transferred onto the coupling face a1 of the base layer 1, a by way of water transfer printing or heat transfer printing. In this embodiment, the compounded transfer layer 3 is transferred onto a top face of the head 1, but is not limited thereto. In other words, the compounded transfer layer 3 may also be transferred onto other portions of the head 1, such as a bottom face or the other side of the head 1.

Referring to FIG. 2, the compounded transfer layer 3 is a water mark or a heat transfer printing material that has a bottom layer 30, a dye layer 31, a protection layer 32 and a film layer 33. The bottom layer 30 is coupled with the coupling face a1 of the base layer 1, a and sandwiched between the coupling face a1 and the dye layer 31. The bottom layer 30 serves as a medium that prevents the substances, which are later applied to the coupling face a1, from coming off the coupling face a1. The bottom layer 30 is formed by a primer paint that can be made of polyurethane, polyester resin, polycarbonate (PC), nylon resin, fluorocarbon, acrylonitrile-butadiene-styrene (ABS), polyacetals, epoxy resin or unsaturated polyester resin. The primer paint may have at least one color serving as the bottom color(s). In addition, the bottom layer 30 may keep the coupling face a1 of the base layer 1, a flat in order to prevent oxidization of the coupling face a1.

The dye layer 31 is arranged on top of the bottom layer 30 and sandwiched between the bottom layer 30 and the protection layer 32. The dye layer 31 is mainly formed by an ink layer and constitutes a pattern 4 with at least one color on the head 1. The pattern 4 may contain a sign, a drawing, a text or other designs. In this embodiment, the pattern 4 is implemented as a sign with two colors as shown in FIG. 1. Preferably, the dye layer 31 has a different color from the bottom layer 30. However, the dye layer 31 may also have the same color as the bottom layer 30, but with different brightness for visual contrast.

The protection layer 32 is applied to one face of the dye layer 31 and sandwiched between the dye layer 31 and the film layer 33. The protection layer 32 is preferably made of polyurethane. Also, the protection layer 32 is transparent in order not to cover the colors of the base layer 1, a and the dye layer 31 while protecting the dye layer 31 from coming off the base layer 1, a due to friction.

The film layer 33 is applied to one face of the protection layer 32 and is made of acrylic resin or other resins. The film layer 33 can be ripped off the dye layer 31 without having residual glue or dye of the dye layer 31 attached thereto.

Figure 3:
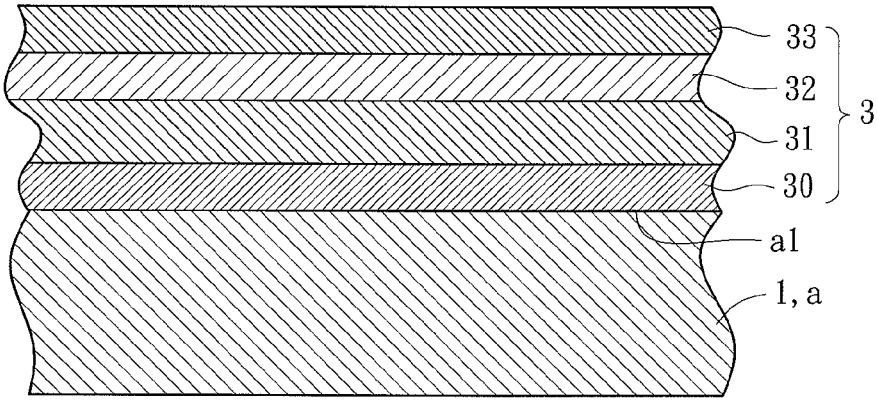
FIG. 3 is a cross-sectional view of the golf club of the first embodiment after the compounded transfer layer is formed on the head of the golf club.
Figure 4:
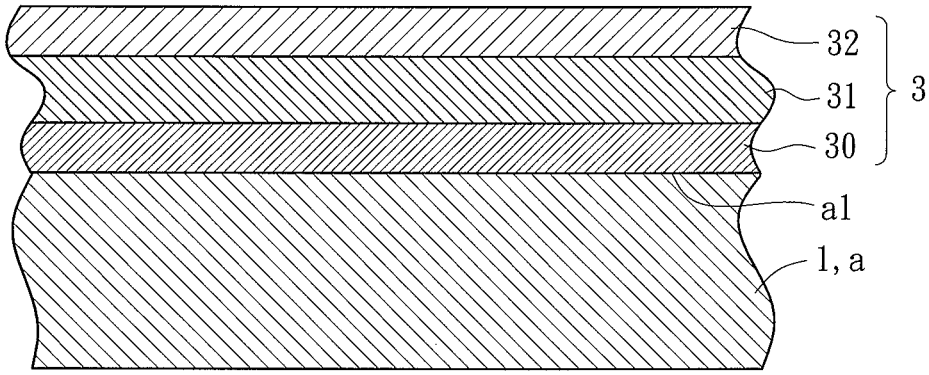
FIG. 4 is a cross-sectional view of the golf club of the first embodiment in which a film layer is removed from the compounded transfer layer.

Referring to FIGS. 2 to 4, a grinding and polishing process and a sand blasting process are applied to the coupling face a1 of the base layer 1, a to keep the coupling face a1 smooth and flat. Then, the compounded transfer layer 3 is transferred onto the coupling face a1 by water transfer printing or heat transfer printing, allowing the bottom layer 30, the dye layer 31, the protection layer 32 and the film layer 33 to stack on the base layer 1, a in order. Based on this, a multiple-layered structure can be formed on the golf club, and the film layer 33 can be ripped off the protection layer 32 thereafter to expose the protection layer 32 to the air (as shown in FIG. 4). As such, the protection layer 32 can protect the pattern 4 without hindering the dye layer 31 from rendering the pattern 4.

Figure 5:
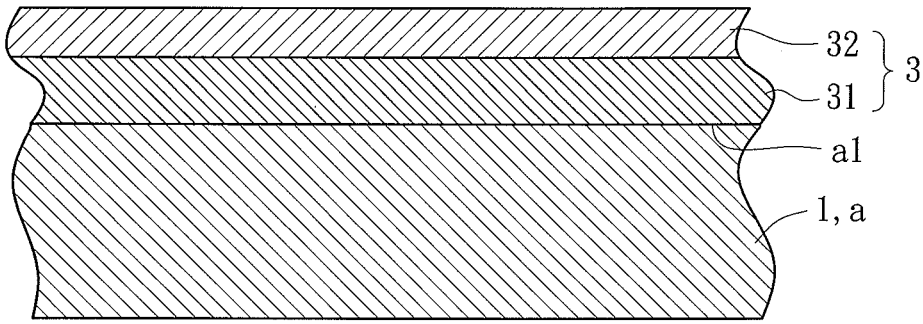
FIG. 5 is a cross-sectional view of the golf club of the first embodiment in which the film layer and a bottom layer are removed from the compounded transfer layer.

Referring to FIG. 5, the bottom layer 30 can be omitted from the compounded transfer layer 3. In this regard, the dye layer 31 and the protection layer 32 can be directly applied to the ball-striking panel 2. With the absence of the bottom layer 30, the head 1 of the golf club can be manufactured in an easier way, simplifying the manufacturing process and shortening the time required.

Figure 6:
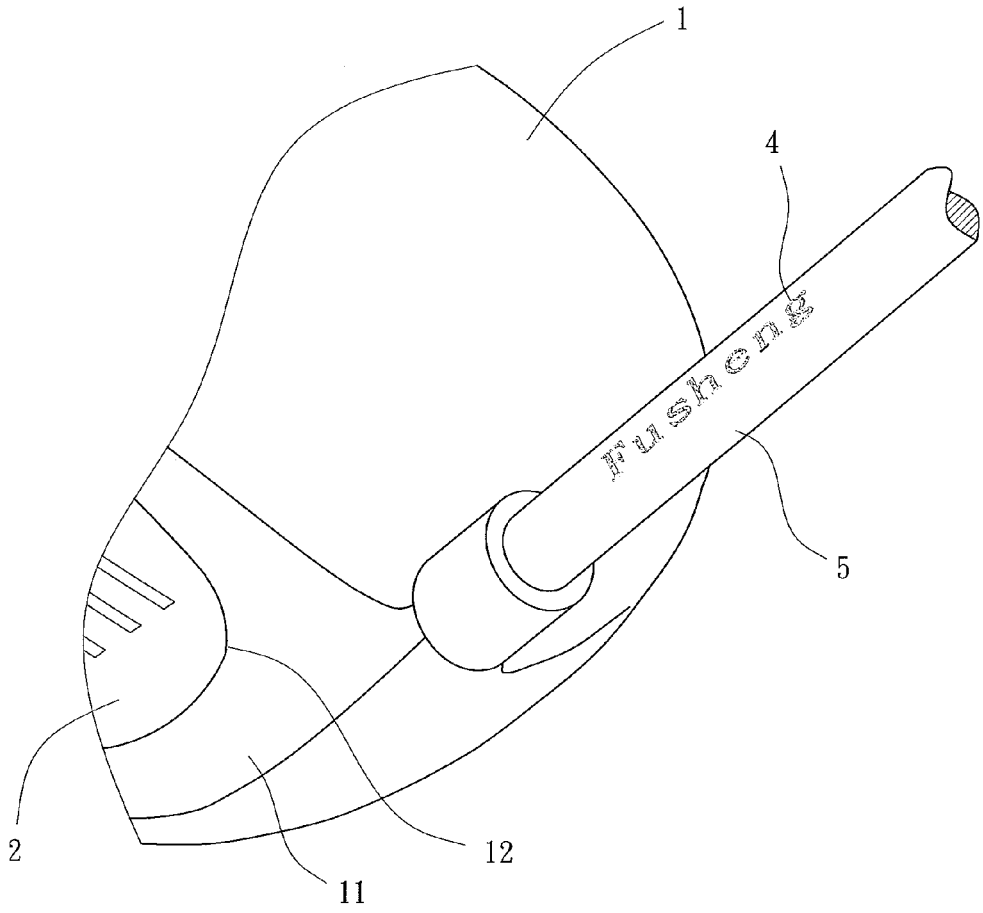
FIG. 6 shows a golf club having a compounded transfer layer formed on a shaft thereof according to a second embodiment of the invention.

Referring to FIG. 6, a golf club is disclosed according to a second embodiment of the invention. In comparison with the first embodiment, the compounded transfer layer 3 is formed on a shaft 5 of the golf club, in which the compounded transfer layer 3 also comprises a bottom layer 30, a dye layer 31, a protection layer 32 and a film layer 33. The structures and characteristics of the bottom layer 30, the dye layer 31, the protection layer 32 and the film layer 33 are similar to the first embodiment, so they are not described herein again for brevity.

The invention is characterized in the ability to form the compounded transfer layer 3 on the head 1 (or on other portions of the head 1) or the shaft 5 in only a single process. Thus, the manufacturing process of the golf club can be simplified for a better production rate.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A golf club having a head, wherein the head comprises:
a base layer having a coupling face; and
a compounded transfer layer formed on the coupling face of the base layer, wherein the compounded transfer layer has a dye layer and a protection layer, wherein the dye layer is sandwiched between the base layer and the protection layer, and wherein the compounded transfer layer further comprises a film layer applied to one face of the protection layer and capable of being ripped off the protection layer.

2. The golf club as claimed in claim 1, wherein the compounded transfer layer further comprises a bottom layer disposed on the coupling face of the base layer and sandwiched between the base layer and the dye layer.

3. The golf club as claimed in claim 1, wherein the dye layer is formed by an ink layer and constitutes a pattern with at least one color on the head of the golf club.

4. The golf club as claimed in claim 1, wherein the protection layer is transparent.

5. A golf club having a shaft, wherein the shaft comprises:
a base layer having a coupling face; and
a compounded transfer layer formed on the coupling face of the base layer, wherein the compounded transfer layer has a dye layer and a protection layer, wherein the dye layer is sandwiched between the base layer and the protection layer, and wherein the compounded transfer layer further comprises a film layer applied to one face of the protection layer and capable of being ripped off the protection layer.

6. The golf club as claimed in claim 5, wherein the compounded transfer layer further comprises a bottom layer disposed on the coupling face of the base layer and sandwiched between the base layer and the dye layer.

7. The golf club as claimed in claim 5, wherein the dye layer is formed by an ink layer and constitutes a pattern with at least one color on the shaft of the golf club.

8. The golf club as claimed in claim 5, wherein the protection layer is transparent.

9. A method for producing a head of a golf club, comprising:
providing a base layer having a coupling face;
forming a compounded transfer layer on the coupling face of the base layer, wherein the compounded transfer layer has a dye layer, a protection layer and a film layer;
sandwiching the dye layer between the base layer and the protection layer; and applying the film layer to one face of the protection layer, wherein the film layer is capable of being ripped off the protection layer.

10. The method for producing a head of a golf club as claimed in claim 9, further comprising disposing a bottom layer of the compounded transfer layer on the coupling face of the base layer and sandwiching the bottom layer between the base layer and the dye layer.

11. The method for producing a head of a golf club as claimed in claim 9, further comprising forming the dye layer by an ink layer, wherein the dye layer constitutes a pattern with at least one color on the head of the golf club.

12. The method for producing a head of a golf club as claimed in claim 9, wherein the protection layer is transparent.

* * * * *